United States Patent [19]

Hathaway

[11] Patent Number: 4,717,135

[45] Date of Patent: Jan. 5, 1988

[54] APPARATUS AND PROCESS FOR AUTOMATICALLY INTERFOLDING SHEETS AND SEPARATING THEM INTO BUNDLES

[75] Inventor: John M. Hathaway, Green Bay, Wis.

[73] Assignee: Kimberly-Clark Corporation, Neenah, Wis.

[21] Appl. No.: 895,778

[22] Filed: Aug. 12, 1986

[51] Int. Cl.[4] ..... B41L 1/32

[52] U.S. Cl. ..... 270/39; 493/357

[58] Field of Search ..... 270/39–41, 270/47, 52, 52.5, 21.1; 215/93, 97–98, 100–101, 103–105; 493/357, 360–363, 430, 424, 379–381, 390, 400–401, 398; 400/613.2, 621

[56] References Cited

U.S. PATENT DOCUMENTS

| | | | |
|---|---|---|---|
| 1,053,914 | 2/1913 | Hudson | 270/39 |
| 1,707,580 | 4/1929 | Shaffer et al. | 270/39 |
| 2,675,747 | 4/1954 | Greiner et al. | 270/39 |
| 2,761,677 | 9/1956 | Rutkus et al. | 270/39 |
| 2,929,624 | 3/1960 | Brooker | 270/39 |
| 3,489,406 | 1/1970 | Nystrand | 270/39 |
| 3,572,681 | 3/1971 | Nystrand | 270/39 |
| 4,163,548 | 8/1979 | Nystrand | 270/39 |
| 4,190,241 | 2/1980 | Krueger | 270/47 |
| 4,279,411 | 7/1981 | Nystrand | 270/39 |
| 4,494,741 | 1/1985 | Fischer et al. | 270/39 |
| 4,508,527 | 4/1985 | Uno et al. | 493/357 |

*Primary Examiner*—E. H. Eickholt

*Attorney, Agent, or Firm*—Gregory E. Croft; Donald L. Traut; Jeremiah J. Duggan

[57] ABSTRACT

Apparatus and process for interfolding a pair of webs into a plurality of bundles, the process comprising conveying the webs through cutting means, a first web-directing means, and a folding means in a first path to form a first bundle, and conveying the webs through cutting means, a second web-directing means, and folding means in a second path to form a second bundle.

11 Claims, 12 Drawing Figures

APPARATUS AND PROCESS FOR AUTOMATICALLY INTERFOLDING SHEETS AND SEPARATING THEM INTO BUNDLES

BACKGROUND OF THE INVENTION

This invention relates to the interfolding of sheets and the separating of the interfolded sheets into bundles. One commercial application of the invention is in the interfolding of paper sheets, such as facial tissue, and the formation of individual bundles of folded sheets. The individual bundles are typically then packaged for commercial sale.

Apparatus and methods are known for interfolding facial tissue and the like automatically. U.S. Pat. No. 2,468,254 Deloye shows conventional techniques for forming folded creases in facial tissue. U.S. Pat. No. 2,761,677 to Rutkus et al. teaches an overall process and apparatus for forming the sheets from separate webs, folding the sheets to form an interfolded stack, having slip sheets at predetermined locations where bundles are to be separated, and subsequently separating the bundles according to the locations of the slip sheets. U.S. Pat. No. 2,675,747 to Greiner et al. teaches separating devices at the discharge area of the folding mechanism for separating quantities of the folded sheets into individual bundles. U.S. Pat. No. 4,190,241 to Krueger teaches also the separation of individual quantities of C-folded sheets at the discharge area of the folding mechanism. U.S. Pat. No. 4,508,527 to Uno et al. also teaches the separating of folded sheets into individual bundles.

It is seen that the above references all teach apparatus and processes for forming discrete bundles wherein the separation into discrete bundles takes place entirely after the folding of the sheets.

It is an object of this invention to provide apparatus and processes for folding sheets and simultaneously separating the folded sheets into discrete bundles, where the separating is initiated before the sheets are deposited onto the stack of folded sheets.

SUMMARY OF THE INVENTION

The invention is seen to be embodied in apparatus for interfolding sheets and separating the sheets into bundles. The apparatus includes a first pair of vacuum cylinders in side-by-side relationship, and a second pair of intermediate, web-directing vacuum cylinders. Each of the web-directing vacuum cylinders in the second pair is adjacent a respective one of the first pair of cylinders. Each of a third pair of folding cylinders is adjacent a respective one of the second pair of cylinders, the third pair of cylinders being in side-by-side relationship with each other.

Preferred apparatus of the invention includes cutting means associated with each one of the first pair of cylinders for cutting in a direction along a line between the ends of the cylinder. The preferred apparatus may also include means, adjacent the first pair of cylinders, for engaging webs of material being processed and breaking bonds between sheets on the first pair of cylinders.

It is preferred that each pair of cylinders be arranged horizontally with the second pair being above the third pair and the first pair being above the second pair. The six cylinders thereby form a stack of cylinders, which, in its most preferred embodiment, is more or less two cylinders wide and three cylinders high. An air nozzle on the outside of the stack and adjacent one cylinder of the second pair of cylinders is preferably included, with the direction of blowing of the air nozzle preferably being oriented in an upward direction.

As part of the take-away apparatus which is part of the folding and separating apparatus of the invention there is desirably included a separator plate and an elevator at the discharge locus of the third pair of cylinders which are the folding cylinders. In some cases it is desirable to include a second separator plate at the discharge locus of the folding cylinders and a second air nozzle adjacent the other one of the second pair of cylinders and oriented to blow upwardly as previously described.

The invention also includes processes for interfolding sheets and separating the sheets into bundles; including carrying the sheets in the process on rotating cylinders. The first step in the process is carrying first and second webs of sheet material through a first line of convergence on a first pair of vacuum cylinders and carrying the webs away from that first line of convergence on a first one of that first pair of cylinders. The sheets are carried away on that first cylinder by engaging vacuum in the lower portion of that cylinder which is toward the first line of convergence. The webs have transverse cuts thereacross, defining individual sheets in the webs. The cuts in the first web are displaced from the cuts in the second web. The next step of the process is transferring the first and second webs from that one cylinder of the first pair of cylinders to a first one of a second pair of intermediate, web-directing vacuum cylinders. The next step is transferring the first and second webs from that first one of the second pair of cylinders to a first one of a third pair of folding cylinders. Following that, the process comprises folding the webs to form a first interfolded bundle.

In the implementation of the process, the transverse cuts across the webs typically have discontinuities in them which comprise bonds between adjacent sheets in the webs, and the process includes the step of breaking those bonds in selected ones of the transverse cuts in the first and second webs before the selected cuts leave the first line of convergence. The breaking of those bonds creates a first web set having trailing sheets in each of the webs ahead of the selected cuts. It also creates the beginning of a second web set having leading sheets in each of the webs behind the selected cuts. In the preferred process the leading sheet in the second web leads the leading sheet in the first web and the leading sheets in the second web set are carried away from the first line of convergence on the second one of the first pair of cylinders by engaging vacuum in the lower portion of that second cylinder which is toward the first line of convergence and disengaging vacuum in the lower portion of the first cylinder. The second web set is then transferred from the second cylinder of the first pair to the second cylinder of the second pair of intermediate, web-directing vacuum cylinders. The second web set is thus arranged on the second web-directing cylinder in layer configuration, with the first web being adjacent, and in general surface-to-surface contact with, the second web-directing cylinder. The second web is adjacent, and in surface-to-surface contact with, the first web. That leading portion of the leading sheet on the first second web which is ahead of the leading sheet on the first web is held, by vacuum, in surface-to-surface contact with the second web-directing cylinder. In the preferred process of the embodiment, the trailing portion of the leading sheet overlies the first web and is held by vacuum to the first web, with the process further including positioning the leading portion of the leading sheet over the trailing portion of the leading sheet, whereby the leading portion is held to the trailing portion by the underlying vacuum in the second web-directing cylinder. The leading edge, then, of the second web set includes the leading edge of the leading sheet in the first web and a middle portion of the leading sheet in the second web, with the leading sheet of the second web being folded back onto itself.

While the leading sheets of the second web set are being processed through the first and second pairs of cylinders, and eventually through the third pair of cylinders, to thereby establish a second web path, the trailing portion of the first web set is continuing to be processed through the cylinders in its first web path, from the first one of the first air of cylinders to the first one of the second pair of cylinders, and from the first one of the second pair of cylinders to the first one of the third pair of cylinders, completing the folding of the first web set into the first interfolded bundle.

While the trailing portions of the first web set are transported through the balance of the apparatus in the folding operation, the leading edge of the second web set is transferred to the second folding cylinder, with timing appropriate to avoid interference with the folding of the trailing portions of the first web set. In some embodiments it is preferred to include the step of increasing the speed of rotation of those cylinders carrying the trailing sheets of the first web set after the transfer of those trailing sheets from the first one of the first pair of cylinders. This would involve the first web-directing cylinder and both folding cylinders. The final portions of the second web pass, and the first bundle is established by inserting a separator plate between the folding cylinders and the first bundle. The leading edge of the second web set is transferred to the second folding cylinder and folding of the sheets in the second web set begins the forming of a second interfolded bundle from the second web set.

When the appropriate number of sheets has been accumulated in the second bundle, the bonds in selected ones of the transverse cuts are again broken in the first and second webs at locations before the webs leave the first line of convergence, thereby creating trailing sheets in the second web set ahead of the broken bonds, and creating the beginning of a third web set having leading sheets in each of the webs behind the broken bonds, the leading sheet in the second web of the third web set leading the leading sheet in the first web of the third web set. The process further includes disengaging the vacuum from the lower portion of the second cylinder of the first pair and engaging vacuum in the lower portion of the first cylinder of the first pair—and namely that lower portion of that cylinder which is toward the first line of convergence.

The above engagement and disengagement of vacuum takes place when an intermediate portion of the leading sheet in the second web is at the first line of convergence. Thus both leading sheets on the third web set are carried away from the first line of convergence on the first cylinder of the first pair of cylinders, although the leading edge of the second web may have initially been held to the second cylinder of the first pair as it started away from the first line of convergence. Nonetheless the transfer of vacuum forces successfully effects the transfer of the entire leading sheet of the second web to the first cylinder of the first pair by the time the entire sheet has passed the first line of convergence.

The invention can broadly be considered to be a process for interfolding sheets in a pair of webs and separating the sheets into a plurality of bundles; with the broadly defined process including the steps of conveying the webs through cutting means, first web-directing means and folding means in a first path to form a first bundle, and conveying the webs through cutting means, second web-directing means, and folding means, all in a second path to form a second bundle. That general process can be elaborated on, in that the webs are carried on rotating cylinders, the pair of webs including a first web and second web. The process includes carrying a length of each of the first and second webs of sheet material, comprising a first web set, through a first line of convergence of a first pair of vacuum cylinders, transferring the first web set to a first web-directing cylinder, transferring the first web set to a first one of a pair of folding cylinders, carrying the first web set on the first folding cylinder into a second line of convergence between the folding cylinders, and interfolding the webs to form a first interfolded bundle, and thereby establishing a first web path between the first line of convergence and the second line of convergence. That process includes then severing the first and second webs, to effect the establishment of the length of each of the first and second webs in the first web set. The severing also creates the beginning of a second web set behind the severance. The process includes then carrying the second web set through the first line of convergence, transferring the second web set to a second web-directing cylinder, transferring the second web set to the second one of the pair of folding cylinders, carrying the second set of the second folding cylinder into the second line of convergence, and interfolding the webs to form a second interfolded bundle. The second web path is thus established between the first line of convergence and the second line of convergence.

Another way of considering the invention is that it provides a process for interfolding a pair of webs and separating the interfolded webs into a plurality of bundles where the process comprises the steps of conveying first portions of the webs through cutting means, first web-directing means, and folding means in the first path, and conveying second portions of the webs through cutting means, second web-directing means, and folding means in a second path.

DETAILED DESCRIPTION OF THE ILLUSTRATED EMBODIMENT

Figure 1:
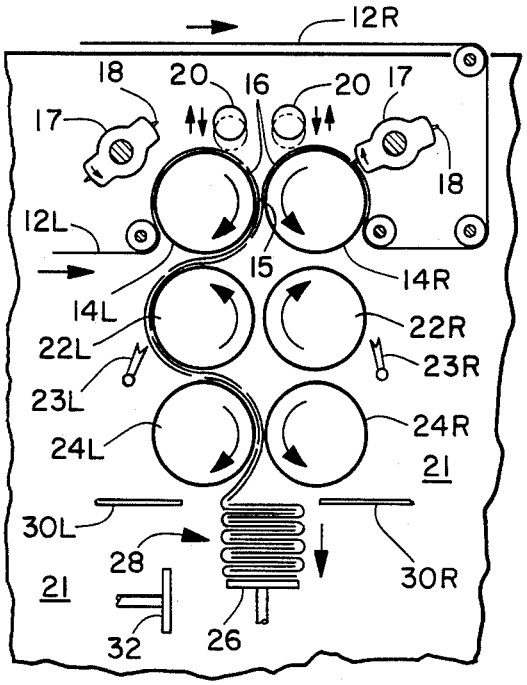
FIG. 1 is a side elevation of apparatus of the invention for interfolding sheets and separating the sheets into bundles.

Referring now to FIG. 1, two webs of paper 12 are fed over left and right anvil cylinders 14L and 14R where they are cut into sheets 16 by cutters 17. Cutting blades 18 are part of cutters 17, and have notches in them for leaving low strength bonds between the sheets. Separator cylinders 20 are mounted on frame 21 and positioned such that they can be momentarily lowered onto anvil cylinders 14. Below anvil cylinders 14 is a second pair of web-directing vacuum cylinders 22L and 22R. Air nozzles 23L and 23R are adjacent the corresponding web-directing cylinder 22L or 22R, and are oriented for directing a stream of air upwardly and more or less tangential to the respective cylinders 22. Below the second pair of vacuum cylinders 22 is a third pair of folding cylinders 24L and 24R. At the discharge side of cylinders 24, namely directly underneath their line of convergence, is an elevator 26 for receiving a stack 28 of folded sheets. Adjacent the discharge area of the folding cylinders, and toward the upper locus of stack 28 are separator plates 30L and 30R. Toward the lower locus of stack 28 and elevator 26 is a pusher 32.

Two webs of paper 12 are fed over the two anvil cylinders 14 and are cut by blades 18 on cutters 17. Blades 18 have notches along their length. As a blade cuts transversely across the web, the notches in the blade leave uncut portions of the web along the line of cutting. These uncut portions provide low strength bonds between the adjacent sheets in the web after the cutting operation. The cut webs, now existing more in the form of connected sheets, further traverse anvil cylinders 14L and 14R and are joined together at the line of convergence 15 of cylinders 14L and 14R. The uncut webs 12 and the sheets 16 are both held to cylinders 14 by the use of vacuum drawn from inside the respective cylinders. As the joined webs 12L and 12R leave the line of convergence 15 they are both held to cylinder 14L by vacuum which is effective in the lower portion of cylinder 14L on that side of the cylinder which is toward the line of convergence 15. As seen in FIG. 1 this would be the lower right quadrant of cylinder 14L. Vacuum on the lower half of cylinder 14R, and particularly toward the line of convergence 15, namely the lower left quadrant, is disengaged.

Webs 12 are carried by cylinder 22L around the left hemisphere of the cylinder, held there by vacuum, and transferred to cylinder 24L at the line of convergence between cylinders 22L and 24L. Webs 12 are then carried on folding cylinder 24L to the line of convergence with companion folding cylinder 24R. Folding cylinders 24L and 24R are conventional folding cylinders. For example, they may be of the type having grippers and tuckers, or they may be of the vacuum type, both of which are well known.

As the sheeted webs leave the line of convergence between cylinders 24L and 24R they are deposited, as a web of folded sheets, in a stack 28 which rests on elevator 26. The stack is built as the folding cylinders alternately fold the paper web to alternating sides through vacuum switching between the cylinders. As paper is stacked on the elevator, the elevator plate is lowered so that the locus of receiving the newly folded webs remains more or less at a consistent height.

When an appropriate number of sheets of the webs 12 has been processed through the stack to provide for a bundle of predetermined sheet count, separator cylinders 20 are momentarily lowered onto anvil cylinders 14. Separator cylinders 20 have a different surface speed than anvil cylinders 14, and thus break the bonds between the sheets at the cuts adjacent the separator cylinders. The breaking of the bonds in webs 12 between sheets 16 creates a first web set comprising the stack and the portions of the two webs 12L and 12R which are ahead of the breaks on the respective webs 12. The first web set has trailing sheets immediately adjacent the web breakage. In the like manner the break creates the beginning of a second web set comprising those portions of the two webs 12L and 12R which are behind the break. Each web 12L and 12R of the second web set has a leading sheet adjacent the break.

Figure 2:
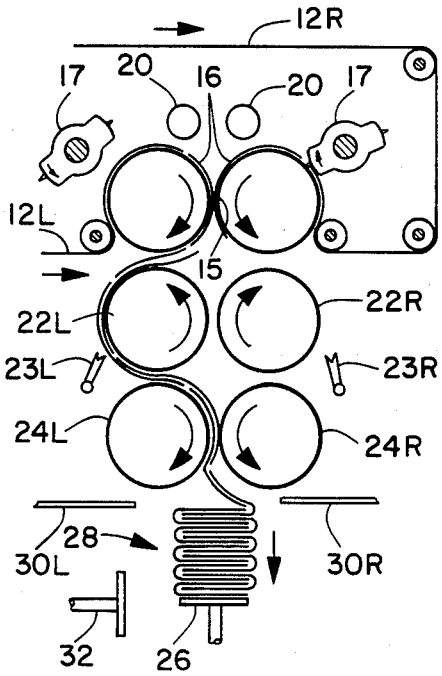
FIG. 2 is a side elevation as in FIG. 1 and showing the beginning of the separating of a first web set from a second web set.
Figure 3:
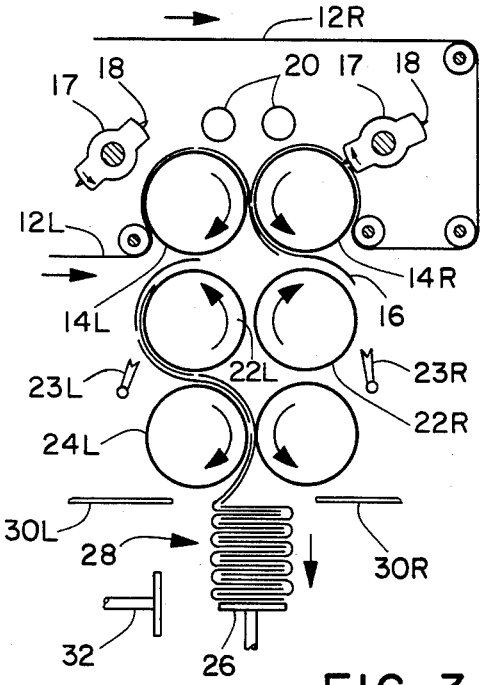
FIG. 3 is a side elevation as in FIG. 2 and showing the initial progress of the second web set into the cylinder arrangements in the invention.
Figure 4:
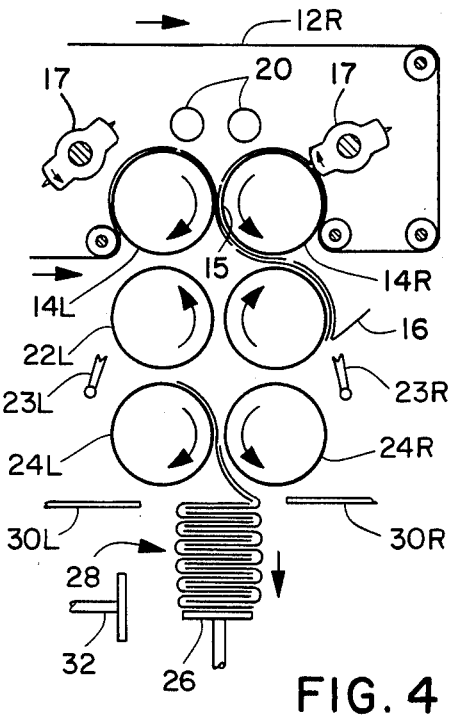
FIG. 4 is a side elevation as in FIG. 3 and showing the folding of the leading portion of the leading sheet of the second web back onto itself in response to air blown from the nozzle.
Figure 5:
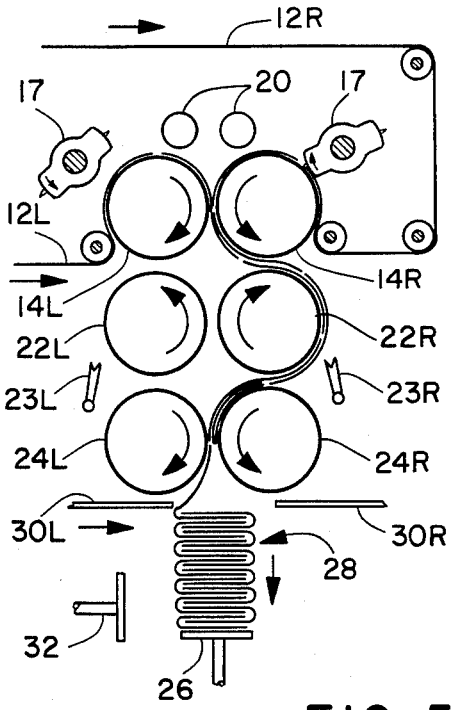
FIG. 5 is a side elevation view as in FIG. 4 and showing the completion of the first bundle from the first web set and the following of the trailing sheet of the first web set by the leading sheet of the second web set.

As the leading sheet of web 12R of the second web set leaves the line of convergence 15, vacuum is engaged in the lower left quadrant of cylinder 14R, resulting in the leading sheet of the second web set being carried away from line of convergence 15 on cylinder 14R, resulting in the leading sheet of the second web set being carried away from line of convergence 15 on cylinder 14R, as seen in FIG. 2. As the trailing sheet of web 12L of the first web set passes through line of convergence 15, vacuum is disengaged in the lower right quadrant of cylinder 14L. As the vacuum is released in cylinder 14L the leading sheet of web 12L in the second web set is drawn to the engaged vacuum in the lower left quadrant of cylinder 14R, as seen in FIG. 3. As all six cylinders continue to rotate as indicated by the arrows in the several figures, and particularly with regard to FIG. 3, the trailing portions of the first web set continue to travel in the path established for that set as seen in FIG. 1. At the same time the second web set commences following a second path which takes it around cylinder 22R as seen in FIGS. 3, 4 and 5. Starting with FIG. 3, the second web set is transferred by vacuum from cylinder 14R to cylinder 22R and is carried by cylinder 22R to folding cylinder 24R. In the second web set on cylinder 22R, web 12L is adjacent, and in surface-to-surface contact, with the cylinder surface. Web 12R is adjacent and in surface-to-surface contact with web 12L and is outwardly of web 12L with respect to the cylinder surface. The leading portion of the leading sheet of web 12R in the second web set is, however, not underlain by the leading sheet in web 12L, in that the leading portion of the leading sheet of web 12R leads the leading portion of the leading sheet of web 12L. Thus the leading portion of the leading sheet in web 12R is held directly adjacent the surface of cylinder 22R as it is carried initially on cylinder 22R, as is seen in FIG. 3. As the leading portion of the leading sheet traverses cylinder 22R the vacuum on cylinder 22R is disengaged in that area of the cylinder which directly underlies the leading portion of the leading sheet of web 22R. As the vacuum is disengaged, a stream of air from nozzle 23R, seen in FIG. 4, blows the leading portion of the leading sheet of the second web back onto the trailing portion of itself. At approximately the same time, the trailing sheets of the first web set are being processed by the folding cylinders 24, again as seen in FIG. 4.

Figure 6:
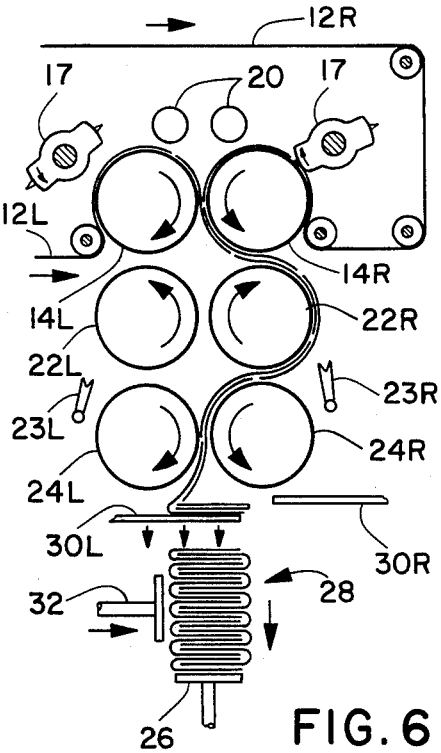
FIG. 6 is a side elevation as in FIG. 5 and showing the initial accumulation of sheets from the second web set as they are discharged from the folding cylinders.

As the folding cylinders finish folding the webs of the first web set, thereby defining a first bundle, made from the first web set, they travel from the left as seen in FIG. 5. Separator plate 30L then moves into the discharge area over the stack as seen in FIGS. 5 and 6. The leading sheets of the second web set follow closely behind the last sheet of the first web set as it is processed by the folding cylinders. The leading sheets of the second web set are folded by the folding cylinders in the customary manner, and are deposited on separator plate 30L as seen in FIG. 6. Concurrently elevator 26 moves downwardly to a removal area where the stack is pushed off the elevator by pusher 32 onto a take-away device such as a conveyor. The elevator 26 then is raised to a position just under separator 30L, and the separator is withdrawn from the stack, leaving the stack on elevator 26. It should be noted that separator plate 30L, and companion plate 30R, as well as elevator 26 have smooth surfaces for easy sliding with respect to the surface of the paper being folded. The smooth surfaces of separators 30 and elevator 26 are significant to their compatibility with the sliding steps, where the plates slide into the stack and out of the stack, and where the bundle slides as it is pushed off the elevator.

Figure 7:
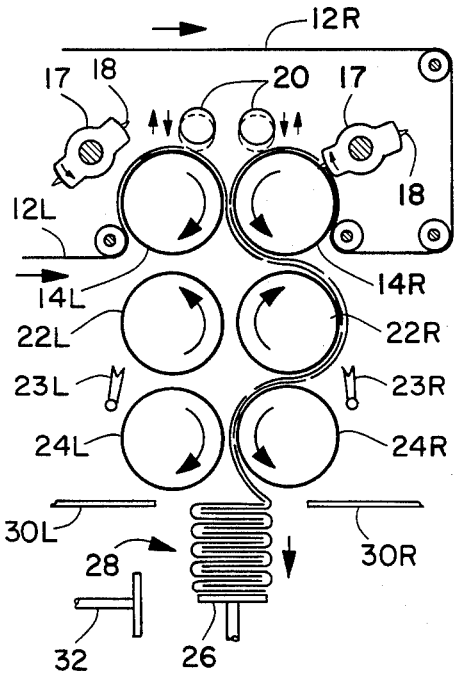
FIGS. 7, 8 and 9 show the completion of the folding of the second web set to form the second bundle and the creation of the leading sheets of a third web set which travels in the first web path.

The web travel continues in the right web path, around web-directing cylinder 22R, until the proper sheet count is reached. At the proper sheet count the separator cylinders 20 momentarily engage against the anvil cylinder 14, again breaking the bonds between the sheets, as shown in FIG. 7. This engagement of the separator cylinders again creates a break in each of the webs 12L and 12R, defining trailing sheets in webs 12L and 12R of the second web set and defining leading sheets in webs 12L and 12R of a third web set.

Figure 8:
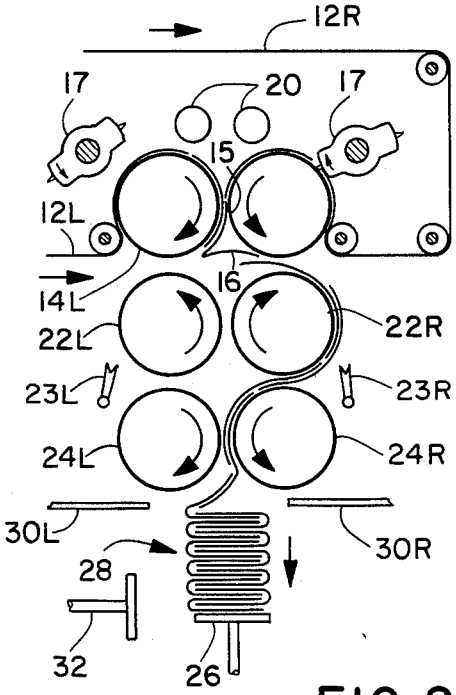

As the leading sheet of web 12R of the third web set leaves the line of convergence 15, vacuum is disengaged in the lower portion of cylinder 14R and is engaged in the lower right quadrant of cylinder 14L. Cylinder 14L pulls both webs over onto itself, and creates a fold-back on the leading sheet in web 12R of the third web set, as seen in FIGS. 8 and 9.

Figure 9:
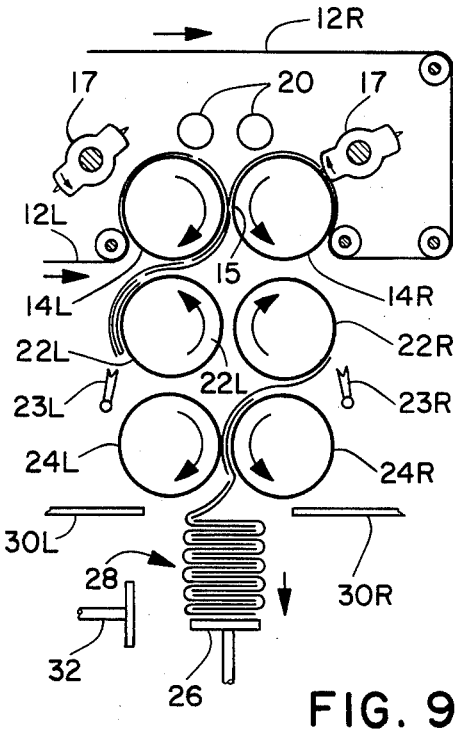
Figure 10:
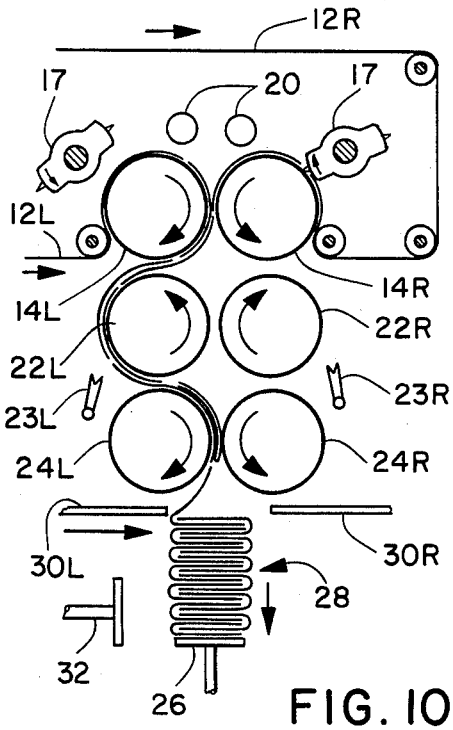
FIGS. 10, 11 and 12 show the third web set following the first web path, as established by the first web set.
Figure 11:
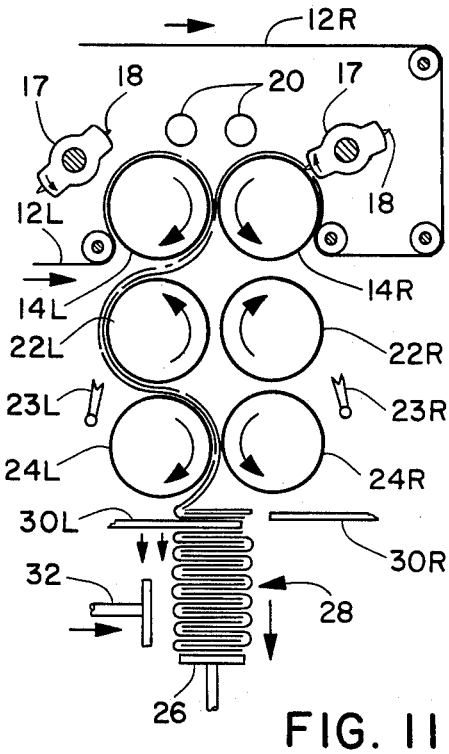
Figure 12:
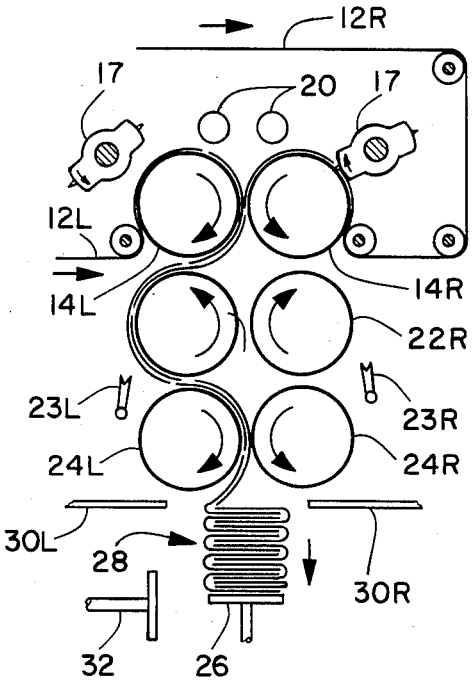

Vacuum on left web-directing cylinder 22L pulls both webs of the third web set around the cylinder and finishes the fold-back of the leading sheet of web 12R, as seen in FIG. 9. Concurrently, the trailing sheets of the second web set continue to be processed through the right web path, including cylinders 22R and 24R, until the second web set is completely folded into the second bundle. The completion of the folded of the second web set is illustrated in FIGS. 9 and 10. As the folding of the second web set is completed, separator plate 30L again moves into the folding area over stack 28, as seen in FIGS. 10 and 11. The third web set is then deposited and accumulated on separator 30L, as the second web set, now defined as the completed second bundle, is removed by elevator 26 and pusher 32. After the elevator 26 has been emptied, it returns to a position just below separator 30L, and 30L is withdrawn from the stack, leaving the accumulating stack on the elevator 26, as seen in FIG. 12.

The process as described is one wherein the sheet count for a given bundle of folded sheets, alternately described herein as a web set, has an even number of sheets. For processing of web sets having an odd number of sheets, the leading sheet in each of alternating web sets would be treated in the same manner, rather than in alternating manners such as in FIGS. 4 and 8. For example, if the leading sheet were on the outside of the pair of webs as in FIG. 4, the leading sheet would always be turned back on itself by the same means. In the illustrated embodiment this would be the nozzle 23R when the right web path is used and nozzle 23L when the left web path is used. It is entirely possible to design the process such that the leading sheet would be toward the inner surface of the web-directing cylinders on the leading sheet of each web set, as seen in FIG. 8. In this event the method of folding the sheet back onto itself would be the method illustrated in FIG. 8, namely the proper engagement and disengagement of vacuum on cylinders 14L and 14R, further with the proper timing; and accompanied by the appropriate vacuum engagement on cylinders 22L and 22R, respectively, as the leading sheets of the web set are transferred to the web-directing cylinder.

As seen in FIGS. 5 and 10, the trailing sheets of a web set may be followed very closely by the leading sheets of the following web set. In order to provide greater spacing between the trailing sheets of the web set being completed by the leading sheets of the subsequent web set, the speed of rotation may be increased, on those cylinders carrying the trailing sheets, as soon as those trailing sheets are transferred from the respective one of the anvil cylinders 14L or 14R onto the respective web-directing cylinder 22. In the series of FIGS. 1 through 5, this means that cylinders 22L, 24L and 24R will be traveling at a faster speed than cylinders 14L, 14R or 22R, and particularly cylinder 22R. The speed can be increased at the point indicated in FIG. 3, where the trailing edge of the trailing sheet of the first web set is being transferred to cylinder 22L. In the operations illustrated in FIGS. 6 through 12, cylinders 22R, 24L and 24R will be increased in speed at a point approximately that shown in FIG. 8. By increasing the speed of the folding cylinders 24 and appropriate web-directing cylinder 22, the speed of folding and delivery of the trailing portions of the corresponding web set is increased, providing additional spacing between that web set and the following web set. This additional spacing provides added tolerance in the timing of the insertion of the separator plate. Also in the embodiments of the process where odd sheet counts are used it is preferred to insert the separator plates from alternate sides of the alternating stacks. For these embodiments of the process, it is preferred to have a second separator plate 30R which can function alternately with 30L on alternate bundles.

Where cutters 18 are used that do not have the indicated notches, and thus completely cut the sheets from each other, the use of separator cylinders may be omitted and the process otherwise operated in a like manner, and wherein it is critical that each sheet be controlled along the entire web path by vacuum as a holding and controlling means.

In some embodiments of the invention where the web material is light, and where the surface speed of the operating cylinders, particularly cylinders 22, is substantial, ambient windage caused by the rotation of the cylinders may be adequate for the folding back of the leading portion of the leading sheet on the outside cylinder, without the use of air from nozzles 23 as shown in FIG. 4.

It is seen then that the invention provides apparatus and process for interfolding a pair of webs, and particularly sheets in a pair of webs, into a plurality of bundles, with the process comprising the primary steps of conveying the webs through cutting means, a first web-directing means, and folding means, in a first path to form a first bundle, and conveying a web through cutting means, a second web-directing means and folding means in a second path to form a second bundle.

This alternating of the web paths provides the primary means for effecting the separation of the bundles from each other.

An advantage of the apparatus and processes of the invention is that it provides the capability to use a relatively simple take-away device such as an elevator and conveyor combination for automatically removing discrete bundles from the folding discharge area, and does not depend on any part of the take-away mechanism for the initial separation of the discrete web sets which form the discrete bundles.

Having thus described the invention, what is claimed is:

1. A process for interfolding sheets and separating said sheets into bundles comprising the steps of:

(a) carrying first and second webs of sheet material through a first line of convergence on a first pair of vacuum cylinders and carrying said webs away from said first line of convergence on a first one of said pair of cylinders by engaging vacuum in the lower portion of said first cylinder which is toward said first line of convergence, said webs having discontinuous transverse cuts thereacross defining individual sheets in said webs, said cuts in said first web being displaced from said cuts in said second web;

(b) transferring said webs from said one cylinder of said first pair of cylinders to a first one of a second pair of intermediate web-directing vacuum cylinders;

(c) transferring said webs from said first one of said second pair of cylinders to a first one of a third pair of folding cylinders;

(d) folding said webs to form a first interfolded bundle; and (e) completely cutting selected ones of said discontinuous transverse cuts in said first and second webs before said selected cuts leave said first line of convergence, thereby creating a first web set having trailing sheets in each said web ahead of said selected severed cuts and creating the beginning of a second web set having leading sheets in each said web behind said selected cuts;

wherein said leading sheet in said second web of said second web set leads said leading sheet in said first web of said second web set, and including carrying said leading sheets of said second web set away from said first line of convergence on said second one of said first pair of cylinders by engaging vacuum in the lower portion of said second cylinder which is toward said first line of convergence and disengaging vacuum in the lower portion of said first cylinder, transferring said second web set from said second cylinder of said first pair to said second cylinder of said second pair of intermediate, web-directing vacuum cylinders, said second web set being arranged on said second web-directing cylinder in layered configuration, said first web being adjacent, and in surface-to-surface contact with, said second web-directing cylinder, said second web being adjacent, and in surface-to-surface contact with, said first web, that leading portion of said leading sheet, on said second web, which is ahead of said leading sheet on said first web, being held, by vacuum, in surface-to-surface contact with said second web-directing cylinder.

2. A process as in claim 1, the trailing portion of said leading sheet overlying said first web and being held by vacuum to said first web, said process further including positioning said leading portion over said trailing portion of said leading sheet, whereby said leading portion is held to said trailing portion by the underlying vacuum in said second web-directing cylinder, the leading edge of said second web set comprising the leading edge of said leading sheet in said first web and a middle portion of said leading sheet in said second web.

3. A process as in claim 1 and including concurrently continuing the transport of the trailing portion of said first web set from said one of said first pair of cylinders to said first one of said second pair of cylinders, from said first one of said second pair of cylinders to said first one of said third pair of cylinders, and completing the folding of said first web set into said first interfolded bundle.

4. A process as in claim 2 and including concurrently continuing the transport of the trailing portion of said first web set from said one of said first pair of cylinders to said first one of said second pair of cylinders, from said first one of said second pair of cylinders to said first one of said third pair of folding cylinders, and completing the folding of said first web set into said first interfolded bundle.

5. A process as in claim 2 or 4 and including the step of transferring the leading edge of said second web set to said second folding cylinder and folding said second web set to form a second interfolded bundle.

6. A process as in claim 3 or 4 and including transferring the leading edge of said second web set to said second folding cylinder and folding sheets in said second web set to begin forming a second interfolded bundle.

7. A process as in claim 1, 3 or 4 and including the step of changing the speed of rotation of the cylinders carrying said trailing sheets relative to the speed of rotation of the cylinders carrying said leading sheets, after the transfer of said trailing sheets from said first one of said first pair of cylinders.

8. A process as in claim 3 or 4 and including inserting a separator plate between said folding cylinders and said first bundle, transferring the leading edge of said second web set to said second folding cylinder and folding sheets in said second web set to begin forming a second interfolded bundle.

9. A process as in claim 6 and including again breaking bonds in selected ones of said transverse cuts in said first and second webs before said webs leave said first line of convergence, thereby creating trailing sheets in said second web set ahead of said broken bonds, and creating the beginning of a third web set having leading sheets in each said web behind said broken bonds, said leading sheet in said second web of said third web set leading said leading sheet in said first web of said third web set, and including disengaging said vacuum from said lower portion of said second cylinder of said first pair and engaging vacuum in the lower portion of said first cylinder, of said first pair, which lower portion is toward said first line of convergence, when an intermediate portion of said leading sheet in said second web of said third web set is at said first line of convergence, whereby both said leading sheets on said third web set are carried away from said first line of convergence on said first cylinder of said first pair of cylinders.

10. A process for interfolding sheets in a pair of webs and separating said sheets into a plurality of bundles, said process comprising the steps of:

(a) conveying said webs through a cutting means, first web-directing means, and folding means in a first path to form a first bundle; and (b) conveying said webs through cutting means, second web-directing means, and folding means in a second path to form a second bundle;

wherein said webs are carried on rotating cylinders, said pair of webs including a first web and a second web, said process including carrying first and second webs of sheet material, comprising a first web set, through a first line of convergence of a pair of vacuum cylinders, transferring said first web set to a first web-directing cylinder, transferring said first web set to a first one of a pair of folding cylinders, carrying said first web set on said first folding cylinder into a second line of convergence between said folding cylinders, and interfolding said webs to form a first interfolded bundle; thereby establishing said first web path between said first line of convergence and said second line of convergence, and subsequently said first bundle, and severing said first and second webs before said webs leave said first line of convergence, thereby creating a second web set behind said severance, carrying said second web set through said first line of convergence, transferring said second web set to a second web-directing cylinder, transferring said second web set to the second one of said pair of folding cylinders, carrying said second web set on said second folding cylinder into said second line of convergence, and interfolding said webs to form a second interfolded bundle; thereby establishing a second web path between said first line of convergence and said second line of convergence, and subsequently said second bundle.

11. A process as in claim 10 wherein said severance creates leading sheets in said first and second webs of said second web set and wherein said leading sheet in said second web leads said leading sheet in said first web, said leading sheet in said second web having a leading portion and a trailing portion, and including the step of positioning said leading portion of said leading sheet in said second web over said trailing portion of said leading sheet on said second web, the leading edge of said second web set then comprising the leading edge of said leading sheet in said first web and a middle portion of said leading sheet in said second web.

* * * * *